United States Patent [19]

Shely et al.

[11] Patent Number: 4,788,751

[45] Date of Patent: Dec. 6, 1988

[54] CABLE TIE

[75] Inventors: William W. Shely; Peter M. Wells, both of Chicago, Ill.

[73] Assignee: All-States Inc., Chicago, Ill.

[21] Appl. No.: 107,295

[22] Filed: Oct. 9, 1987

[51] Int. Cl.[4] ..... B65D 63/00

[52] U.S. Cl. ..... 24/16 PB; 24/17 AP

[58] Field of Search ..... 24/16 PB, 17 A, 17 AP, 24/30.5 P, 20 TT; 248/74.3; 292/318, 320, 322

[56] References Cited

U.S. PATENT DOCUMENTS

| | | | |
|---|---|---|---|
| 3,102,311 | 9/1963 | Martin et al. | 24/16 PB |
| 3,494,002 | 2/1970 | Kabel | 24/16 PB |
| 3,605,199 | 9/1971 | Eberhardt | 24/16 PB |
| 4,128,919 | 12/1978 | Bulanda et al. | 24/20 TT |
| 4,263,697 | 4/1981 | Speedie | 24/30.5 P |
| 4,573,242 | 3/1986 | Lankton et al. | 24/17 AP |

FOREIGN PATENT DOCUMENTS

| | | | |
|---|---|---|---|
| 2139091 | 3/1972 | Fed. Rep. of Germany | 24/16 PB |

*Primary Examiner*—Victor N. Sakran

*Attorney, Agent, or Firm*—Laff, Whitesel, Conte & Saret

[57] ABSTRACT

A cable tie has a plurality of spaced parallel racks of teeth extending along the length thereof. A reinforcing median strip extends down the strap between the racks of teeth in order to add material thickness, and therefore a mechanical strength to the strap. The pawl is bifurcated so that a separate pawl engages each rack of teeth. The teeth in each rack are offset from each other so that no deep notch extends more than approximately half way across the strap at any given transverse location. The teeth in the pawls are offset in a similar manner.

9 Claims, 1 Drawing Sheet

CABLE TIE

This invention relates to cable ties and more particularly to cable ties with a more reliable holding characteristic and a reduced insertion force.

Cable ties are molded plastic devices having a strap and a head. The strap has a rack of transverse teeth extending along the length thereof. The head includes an opening containing a pawl which mates with and ratchets over the rack of teeth on the strap. The end of the strap is inserted through the opening and then pulled tight. As the strap tightens, the pawl locks into the teeth to prevent the strap from loosening. An example of such a cable tie is found in U.S. Pat. No. 3,605,199.

These cable ties have become devices having general utility which serve many different uses ranging from automobile construction through bundling wires, to almost anything else which might require a strap tied around it. The wide spread use of cable ties attests to their reliability, convenience, and overall utility. Nevertheless, problems persist For example, in some hostile environments the strap may break, especially at the point where the pawl locks into it. The hostile environment may include a combination of many factors, the most common of which involves very low humidity or low humidity combined with low temperature or high temperature.

Another and related problem is that the insertion force required to insert the strap through the hole in the head. This insertion force might increase substantially if an effort is made to solve the strap breakage problem merely by increasing the thickness of the strap. An increased strap thickness increases the bending characteristics (more rigid) when wrapping a cable tie around a circular bundle. Insertion force need not necessarily be increased by a thicker strap if allowance is provided in the head. Therefore, an objective in solving the strap breakage problem is to provide a greater than average thickness while avoiding a substantial increase in the insertion or bending forces that would result from a greater amount of material in the strap and the pawl. This objective is accomplished by providing two locking pawls, both must break before the strap will be released. Two examples of dual locking devices, which are not on cable ties, are found in U.S. Pat. Nos. 4,128,919 and 3,155,987. Since these two patents are not cable ties, they do not face the problems outlined above such as increased insertion force, change in effective cable tie thickness, etc. which increases the stiffness of the strap and makes it more rigid in bending.

Accordingly, an object of this invention is to provide new and novel cable ties, especially for use in hostile environments. Here, an object is to provide cable ties for use in environments having an extremely low humidity and/or low or high temperature.

Another object of the invention is to increase the effective thickness of a cable tie strap without substantially increasing the amount of material in said cable ties. Here, an object is provide a cable tie strap having a substantially greater averages thickness without simultaneously increasing the insertion forces required to install the cable tie. In this connection, an object is to reduce the notch effect caused by the transverse teeth extending across substantially the entire width of the strap.

Yet another object of the invention is to provide pawls having a reduced insertion force without simultaneously reducing the thickness of the pawl hinge.

In keeping with an aspect of the invention, these and other objects are accomplished by providing a median strip down the middle of a rack of teeth and extending longitudinally along the length of the cable tie strap. The median strip leaves two racks of strap teeth, each rack having a width approximately equal to half of the width of the previously used rack of teeth. The teeth on one side of the median strip are offset a half step as compared to the teeth on the opposite side of the median strip so that the root of the strap tooth notch on one side of the median does not coincide with the root of the opposing tooth on the opposite side of the median. The pawl is bifurcated to straddle the median strip, with each pawl engaging an individually associated one of the two racks of teeth. The pawl on one side of the cable tie has teeth which are a half a tooth higher than the teeth on the opposite pawl so that both pawls engage a locking tooth at the same time.

A preferred embodiment of the invention is shown in the attached drawing, wherein:

FIG. 1 is a plan view showing the top of the inventive cable tie;

FIG. 2 a side elevation of the cable tie shown in FIG. 1, with the head shown in cross-section to reveal the pawl;

Figures 1, 2, 3, 4, 5, 6, 7, 8, 9, 10:
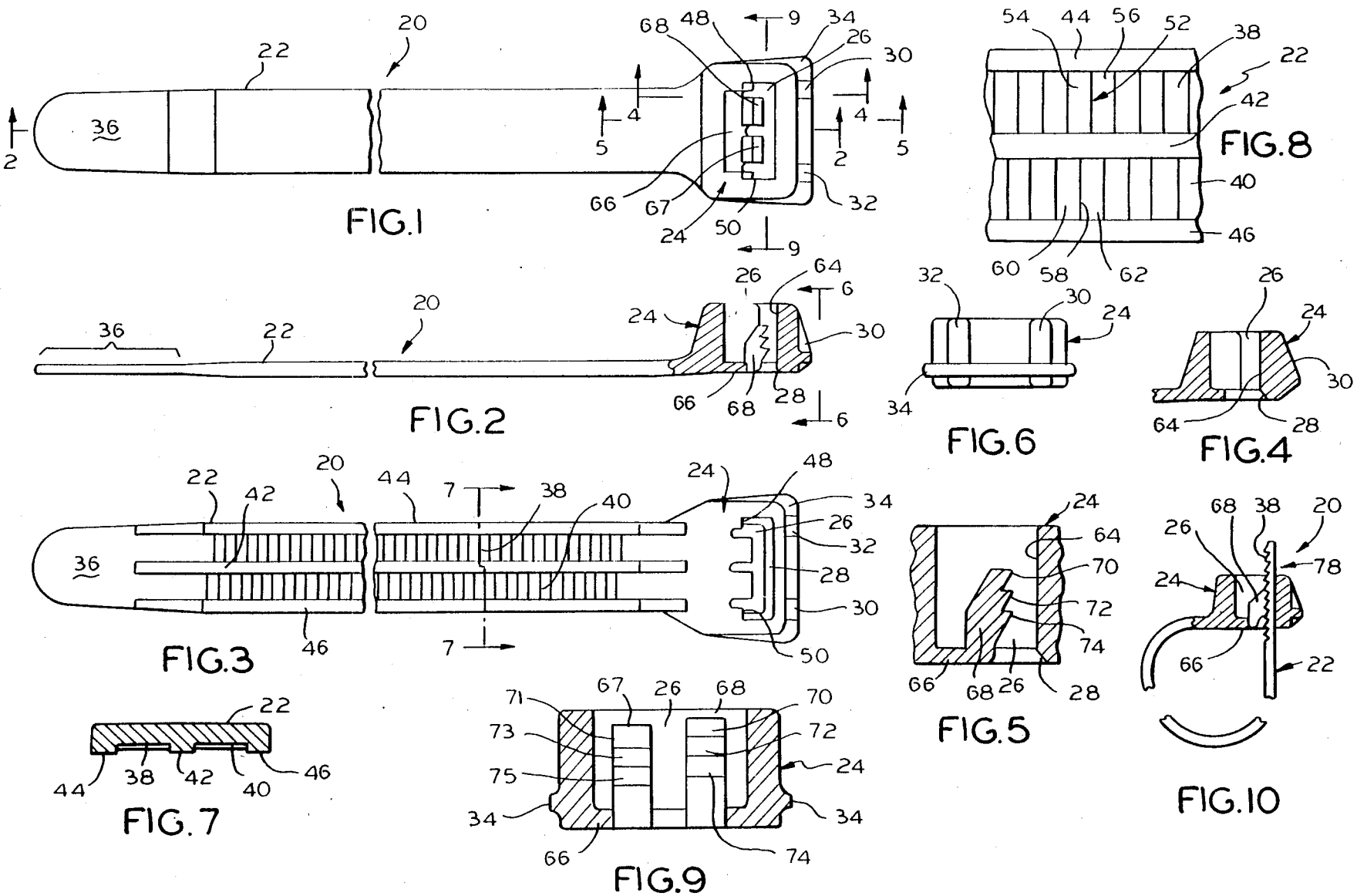
FIG. 3 is a plan view showing the bottom of the cable tie and revealing the median strip with two racks of teeth.
FIG. 4 is a cross-section of the head of the cable tie, taken along line 4—4 of FIG. 1.
FIG. 5 is a cross-section of the head taken along line 5—5 of FIG. 1.
FIG. 6 is an end view of the cable tie, taken along line 6—6 of FIG. 2.
FIG. 7 is a cross-section of the strap taken along line 7—7 of FIG. 3.
FIG. 8 is a fragmentary plan view showing an embodiment of the strap with teeth on one side of the median strip which are offset relative to the teeth on the other side of the strip.
FIG. 9 is a cross-section of the head taken along line 9—9 of FIG. 1 and showing how the pawl teeth are offset to match the position of the teeth in the embodiment of FIG. 8.
FIG. 10 shows a cable tie which has been locked with the strap extending through the head and being held by the pawl.

As best seen in FIGS. 1-3, the cable tie 20 has an integral strap 22 and head 24. The head 24 has an opening 26 through which the strap may be threaded. The bottom of opening 26 is chamfered at 28 to assist strap insertion. Reinforcing ribs 30, 32, 34 reinforce the head walls to provide a greater strength and rigidity.

The opposite and outer end 36 of the strap is rounded and thinner to facilitate an insertion of the strap end into the head opening. Also the thinness of section 36 makes it easier to thread the strap through a narrow place of installation and to cause it to begin to curl back upon itself so that the end may be grasped and pulled into a threading position. For example, if the cable tie strap has to be threaded through a bundle of wires resting against a wall, the thinness of end 36 makes it easier for the tip end to engage the wall and to be deflected back upon itself.

Extending along the length of the strap 22 are two racks 38, 40 of teeth, separated by a raised, reinforcing median strip 42. The outside side walls 44, 46 provide smooth side rails for sliding against shoulders 48, 50 in the head opening 26.

As best seen in FIG. 8, a preferred embodiment has teeth in the rack 38 on one side of median strip 42 offset from the teeth in the rack 40 on the opposite side of the median strip. For example, the line 52 represents both the crest of tooth 54 and the root of tooth 56. The line 58, which is the crest of tooth 60 and the root of tooth 62, is offset from the root 52 of tooth 56. Since the root of a tooth is the thinnest part of the strap, that thinness does not extend more than halfway (excluding median strip 42, and side walls 44, 46) across the inventive strap. Thus the average total strap thickness at 52 includes the full height of walls 44, 46, median strip 42, the root thickness at 52 and half of the average thickness of tooth 62.

In the prior art, the median strip 42 was not present and the root line of each tooth extended in a straight line from side rail 44 to side rail 46. Therefore, the thinnest part of the strap extended not only across the entire width of the strap, but also was repeated at the root of every tooth. This gives a repetition of the weakest possible strap thicknesses. With the invention, the strap at the tooth root 52 has half of its maximum thickness at the transversely opposite position where the strap at the tooth 62 has its minimum thickness. This means that the strap 22 never has a minimum thickness comparable to the minimum thickness of the conventional cable tie strap. To this inventive increase in minimum strap thickness, add the thickness of the median strip 42 (FIG. 7).

The details of head 24 of the cable tie 20 are shown in FIGS. 4, 5, 6, 9. The outside wall of the head is reinforced by an equitorial girdle 34 extending horizontally around the abuttment wall 64 against which the pawls bears. Vertically, a pair of upstanding pillars 30, 32 also reinforce the abuttment wall.

Inside the opening, a hinge area 66 extends over approximately the half of opening 26 which is closest to the strap. Upstanding on this hinge area 66 is a pair of pawls 67, 68. Each pawl has a plurality of teeth with contours which are complementary to the contours of the rack teeth. As best seen in FIG. 9, the teeth 70, 72, 74 on pawl 68 are displaced from corresponding teeth 71, 73, 75 of pawl 67, to correspond to the displacement (FIG. 8) of the teeth in rack 38, with respect to the position of the teeth in rack 40. Thus, each tooth in each of the pawls simultaneously abutts against a corresponding tooth in the strap to provide a simultaneous lock upon the strap.

FIG. 10 shows the use of the cable tie 20, wherein the end of the strap 22 has passed through the opening 26 in the head 24. The racks of teeth have passed the pawls, which have ratcheted over them in order to enable the strap to tighten. As shown in FIG. 10, the teeth on rack 40 have meshed into the teeth on pawl 68 which is propped in a locking position against the engaged strap teeth. Responsive to the memory of the plastic, the pawl is pressed against the strap with a force which is sufficient to prevent it from being withdrawn from the head. In a similar manner, the pawl 67 (FIG. 9) is locked into teeth of the rack 38. Usually the strap is pulled to a predetermined tension and then cutoff at the point 78 (FIG. 10) where it emerges from head 24.

Since the total tooth width of pawls 67, 68 is less than the corresponding width of a pawl extending across the entire cable tie strap, a reduced insertion force is required to thread the strap end through the opening 26.

Despite this reduced insertion force, the hinge area 66 retains all of the thickness which is required when the strap tooth extends across the entire width of the strap. Therefore, the hinge is not weakened. Moreover the offset tooth position illustrated in FIG. 8 maintains a greater average strap thickness and avoids the notch effect weakness at the root of the tooth. Further, as shown in FIG. 7, the added thickness of center median 42 plus the offset teeth gives the strap approximately 25% more strap material in the thickness direction, as compared to the thickness of the prior art strap which had only the side rails 44, 46. Finally, the addition of a second independent pawl inherently tends to increase reliability over a single pawl since two simultaneous failures are much less likely to occur than a single failure.

Those who are skilled in the art will readily perceive how to modify the invention. Therefore, the appended claims are to be construed to cover all equivalent structures which fall within the true scope and spirit of the invention.

The claimed invention is:

1. A cable tie comprising a unitary strap and head, said strap having a spaced parallel pair of racks of teeth extending along the length thereof, said racks being separated by a median strip having a full strap thickness, the teeth in one of said racks being transversely offset relative to the teeth in the other of said racks whereby the areas of minimum strap thinness do not coincide in the two racks and a pair of pawls positioned side-by-side in said head to confront individually associated ones of said racks of teeth, the space between said pawls being approximately equal to the width of said median strip so that each pawl ratches over its individually associated one of said rack of teeth.

2. The cable tie of claim 1 wherein each rack tooth has a predetermined width and said offset is substantially equal to a half of a tooth width.

3. The cable tie of claim 2 wherein the teeth on one of said pawls is displaced from the teeth on the other of said pawls by a distance which is substantially equal to a half of a tooth width.

4. The cable tie of claim 1 wherein each of said pawls has a plurality of teeth with contours which are complementary to the contours of the rack teeth.

5. A fastener comprising strap means having a securing means at one end, the opposite end of said strap being free, said strap means having two spaced parallel rows of teeth extending along the length thereof, said two rows being separated by a median strip having a thickness which is substantially as great as at least the thickness of said strap at a crest of said teeth, the teeth in one of said rows being offset relative to the teeth in the other of said rows so that on the average the root of a tooth does not extend over more than approximately one half the width of said strap and a pawl associated with each of said rows of teeth, each pawl having teeth which are complementary to and which ratchet over and latch into said teeth in the row associated therewith.

6. The fastener of claim 5 wherein each pawl has a plurality of teeth, the teeth on one of said pawls being offset relative to the teeth on the other pawl whereby both of said pawls simultaneously prop themselves against the teeth in said tow rows of said teeth.

7. An integral elongated plastic device having a continuous and unbroken strap on one end and a fastener on the other end, a plurality of rows of spaced parallel teeth extending along the length of the strap, each of said teeth rising from a root to a crest with at least a minimum amount of plastic strap thickness at said root and a maximum amount of plastic strap thickness at said crest said crest of one tooth terminating in a substantially perpendicular wall at the root of the next tooth, the average strap thickness at any transverse location along the length of said strap being greater than said minimum thickness, a median strip means extending along the length of said strap between adjacent rows of said teeth and having a plastic strap thickness at least as great as said maximum thickness whereby the total strip thickness at said root is at least is great as said average thickness plus the thickness of said median strip a hinged pawl securing means on said fastener end individually associated with each of said rows for ratcheting over said teeth, propping against at least the wall of one tooth, and locking into at least said one of said tooth to preclude a loosening of said strap means.

8. The device of claim 7 wherein said securing means comprises a pawl for propping itself against teeth in said row of teeth to prevent a reverse movement of said strap.

9. The device of claim 8 wherein the teeth against which said securing means is propped are transversely distributed across the width of said strap.

* * * * *